US008021048B2

(12) United States Patent
Ackerman

(10) Patent No.: US 8,021,048 B2
(45) Date of Patent: Sep. 20, 2011

(54) END-STOMP AND CLOSURE MECHANISM FOR A RECLOSABLE POUCH

(75) Inventor: Bryan L. Ackerman, Freeland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 409 days.

(21) Appl. No.: 12/322,416

(22) Filed: Feb. 2, 2009

(65) Prior Publication Data

US 2010/0195936 A1 Aug. 5, 2010

(51) Int. Cl.
*B65D 33/16* (2006.01)
*A44B 1/04* (2006.01)

(52) U.S. Cl. ..... 383/64; 24/399

(58) Field of Classification Search ..... 383/64; 24/399, 400

See application file for complete search history.

(56) References Cited

U.S. PATENT DOCUMENTS 5,067,208 A 11/1991 Herrington, Jr. et al.
5,088,971 A 2/1992 Herrington
5,131,121 A 7/1992 Herrington, Jr. et al.
5,161,286 A 11/1992 Herrington, Jr. et al.
5,405,478 A 4/1995 Richardson et al.
5,442,837 A 8/1995 Morgan
5,448,807 A 9/1995 Herrington, Jr.
5,482,375 A 1/1996 Richardson et al.
5,664,299 A 9/1997 Porchia et al.
5,833,791 A 11/1998 Bryniarski et al.
5,871,281 A 2/1999 Stolmeier et al.
5,924,173 A 7/1999 Dobreski et al.
5,956,815 A 9/1999 O'Connor et al.
5,956,924 A 9/1999 Thieman
6,088,887 A 7/2000 Bois
6,178,602 B1 1/2001 Burke et al.
6,220,754 B1 4/2001 Stiglic et al.
6,287,001 B1 9/2001 Buchman
6,290,391 B1 9/2001 Buchman
6,357,914 B1 3/2002 Kinigakis et al.
6,385,818 B1 5/2002 Savicki
6,431,754 B1 8/2002 Savicki, Sr.
6,442,804 B2 9/2002 Turvey et al.
6,508,969 B1 1/2003 Kolovich et al.
6,517,242 B1 2/2003 Buchman
6,595,689 B1 7/2003 Borchardt et al.
6,611,996 B2 9/2003 Blythe et al.
6,662,410 B2 12/2003 Kolovich et al.
6,686,005 B2 2/2004 White et al.
6,761,481 B1 7/2004 Bois
6,840,675 B2 * 1/2005 Knight ..... 383/64
6,843,600 B2 1/2005 Tilman et al.
6,846,107 B2 1/2005 Sweeney et al.
6,948,849 B2 9/2005 Schreiter
6,996,879 B1 2/2006 Savicki
(Continued)

*Primary Examiner* — Jes F Pascua

(57) ABSTRACT

A closure mechanism extends between side edges of a reclosable pouch and includes complementary interlocking closure elements each having an elongate profile extending between first and second ends thereof. Guide rails are disposed along exterior sides of the complementary interlocking closure elements. A slider is disposed in straddling relation over the guide rails and an end-stomp is defined by a fused-together portion of the interlocking closure elements proximate an end of the closure mechanism. The end-stomp may include a flattened region, a first raised ridge that is generally parallel to the interlocking closure elements, and a second raised ridge that is generally perpendicular to the first raised ridge. The second raised ridge extends away from a pouch interior and beyond opening side lateral edges of the complementary interlocking closure elements a distance that is sufficient to engage a top wall of the slider.

14 Claims, 3 Drawing Sheets

U.S. PATENT DOCUMENTS

| | | | | |
|---|---|---|---|---|
| 7,033,451 | B2 | 4/2006 | McMahon et al. | |
| 7,040,809 | B2 * | 5/2006 | Pokusa | 383/64 |
| 7,044,639 | B2 | 5/2006 | Chang | |
| 7,090,397 | B2 | 8/2006 | Stolmeier | |
| 7,134,192 | B1 | 11/2006 | Savicki et al. | |
| 7,267,856 | B2 | 9/2007 | Patel et al. | |
| 7,305,742 | B2 | 12/2007 | Anderson | |
| 7,347,908 | B2 | 3/2008 | Share et al. | |
| 7,458,925 | B2 | 12/2008 | Turvey | |
| 7,882,603 | B2 * | 2/2011 | Bentsen | 24/436 |
| 2005/0025394 | A1 | 2/2005 | Kinigakis et al. | |
| 2006/0269170 | A1 | 11/2006 | Chaturvedi | |
| 2007/0154118 | A1 | 7/2007 | Tilman et al. | |
| 2007/0177827 | A1 | 8/2007 | Tilman | |
| 2007/0240288 | A1 | 10/2007 | Bentsen | |
| 2008/0172842 | A1 | 7/2008 | Blythe et al. | |

* cited by examiner

END-STOMP AND CLOSURE MECHANISM FOR A RECLOSABLE POUCH

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present disclosure relates generally to various aspects of a reclosable pouch, a closure mechanism for the pouch, and an end-stomp for the closure mechanism.

2. Description of the Background of the Invention

A slider applied to closure elements on a reclosable flexible storage pouch can provide a quick and easy way to close and reopen the pouch. However, it is not uncommon that a user may provide excessive force in actuating the slider and may inadvertently pull the slider off of the closure elements, either transversely across the closure elements or longitudinally off an end of the closure elements. It is known that transverse slider pull-off may be inhibited with guide rails and longitudinal slider pull-off may be inhibited with end-stomps. End-stomps may also provide an additional seal to a slider-actuated closure mechanism proximate to an end thereof.

For example, one slider-actuated closure mechanism utilizes a permanent seal to provide additional sealing at an end of a pair of complementary closure elements in an occluded state. A permanently sealed region is disposed at a region of the complementary closure elements bounded by an end seam. The sealed region is disposed below an unsealed region of the complementary closure elements at a top corner thereof. A slider separator finger is accommodated by the unsealed region when the complementary closure elements are in the occluded state. Another slider-actuated closure mechanism has portions of first and second closure elements that are melted together to form end seals thereon. Each of the end seals is supplemented by a second seal that is discontinuous with the end seal and is disposed in close proximity to a bottom edge of the first and second closure elements. Each of the second seals extends upwardly to a point between the bottom edge and a top edge of the first and second closure elements.

One slider-actuated closure mechanism that inhibits slider pull-off has asymmetric first and second closure elements. A slider is straddlingly attached over the closure elements and has asymmetric inwardly turned retaining flanges that extend beneath asymmetric shoulders of the closure elements to inhibit slider pull-off transverse to the closure elements. Another such slider-actuated closure mechanism has a slider that has in-turned shoulders that straddle ridges on outer surfaces of the closure elements to inhibit transverse slider pull-off.

A further pull-off inhibiting slider-actuated closure mechanism has a slider that is straddlingly disposed on rib and groove closure elements such that in-turned shoulders on ends of sidewalls of the slider are positioned beneath a bottom side of the closure elements to inhibit vertical (i.e., transverse) slider pull-off. Laterally transverse protruding end-stomps are integrally molded into ends of the rib and groove closure elements. Each of the end-stomps is produced by fusing the rib and groove elements together proximate the opposite ends thereof with a known ultrasonic crushing mechanism to form a thinned portion juxtaposed with a rounded or arrowhead shaped thickened portion having lateral (i.e., horizontally transverse) protrusions. The slider has a top wall from which depends a pair of side walls that are blocked from moving past each end-stomp by the lateral protrusions thereon to inhibit longitudinal slider pull-off.

Another slider-actuated closure mechanism has end-stomps that are formed by ultrasonically sealing opposed walls of the closure mechanism such that a top edge of each end-stomp extends vertically beyond an exterior lateral edge of the closure mechanism proximate to the ends thereof. The top edge of each end-stomp smoothly transitions or ramps down at an obtuse angle to the level of the exterior lateral edge on a side of the end-stomp opposite the corresponding end of the closure mechanism. Each end-stomp is also illustrated to have a plurality of diagonal features running from a pouch interior side of the end-stomp to the top edge of the end-stomp.

Material costs can be an important consideration in the design of components of a slider-actuated closure mechanism. The effectiveness of the above-described arrangements for inhibiting slider pull-off can vary with the strength and quantity of material used to manufacture the components. A particular arrangement may have good slider pull-off resistance when utilized on a relatively expensive and strong material for the slider and the closure mechanisms, for example, polybutylene terephthalate (PBT). However, the particular arrangement may have diminished slider pull-off resistance when one or more components is made of relatively less material and/or a relatively less expensive and/or weaker material, for example, polypropylene. Accordingly, an object of the present invention is in some instances to provide an improved arrangement of and end-stomp and slider combination manufactured from relatively less material and/or from the relatively less expensive and/or weaker material that can provide slider pull-off resistance that is comparable to the slider pull-off resistance of known arrangements utilizing relatively more material and/or the relatively expensive and strong material.

SUMMARY OF THE INVENTION

According to one aspect of the invention, a reclosable pouch includes first and second pouch sidewalls attached together to define a pouch interior having an opening defined by unattached edges of the first and second pouch sidewalls. A closure mechanism extends between a first side edge and a second side edge of the pouch. The closure mechanism includes first and second complementary interlocking closure elements attached proximate to the unattached edges of the first and second pouch sidewalls, respectively, each closure element having an elongate profile extending between a first end and a second end. First and second guide rails are disposed on exterior sides of the first and second complementary interlocking closure elements, respectively, wherein each of the guide rails extends completely from the first side edge to the second side edge. A slider is disposed in straddling relation over the guide rails of the first and second complementary interlocking closure elements. An end-stomp is defined by a fused-together portion of the first and second interlocking closure elements proximate one of the ends of the closure mechanism. The end-stomp includes a flattened region, a first raised ridge that is substantially parallel to the interlocking closure elements, and a second raised ridge that is substantially perpendicular to the first raised ridge. The second raised ridge abuts an un-fused region of the closure mechanism and extends away from the pouch interior and beyond opening side lateral edges of the first and second complementary interlocking closure elements a distance that is at least as large as a vertical thickness of a slider top wall. Each of the first raised ridge and the second raised ridge has a first lateral thickness greater than a second lateral thickness of the flattened region.

According to another aspect of the invention, a closure mechanism for a reclosable pouch includes first and second complementary elongate interlocking closure elements and a slider disposed in straddling relationship to the first and second closure elements and adapted to slide along a length of and occlude and deocclude the closure elements. An end-stomp is disposed proximate an end of the closure mechanism, the end-stomp defined by a fused-together region of the first and second complementary interlocking closure elements that includes a flattened region, a first raised ridge that is substantially parallel to the interlocking closure elements, and a second raised ridge that is substantially perpendicular to the first raised ridge. The second raised ridge abuts an un-fused region of the closure mechanism and extends away from the pouch interior and beyond opening side lateral edges of the first and second complementary interlocking closure elements. Each of the first raised ridge and the second raised ridge has a first lateral thickness greater than a second lateral thickness of the flattened region. First and second guide rails are disposed along the first and second complementary interlocking closure elements, respectively.

According to yet another aspect of the invention, an end-stomp of a closure mechanism for a reclosable pouch includes a fused-together region of first and second complementary interlocking closure elements. The fused-together region includes a flattened region, a first raised ridge that is substantially parallel to the interlocking closure elements, and a second raised ridge that is substantially perpendicular to the first raised ridge. The second raised ridge abuts an un-fused region of the closure mechanism and extends beyond exterior lateral edges of the first and second complementary interlocking closure elements. Each of the first raised ridge and the second raised ridge has a first lateral thickness greater than a second lateral thickness of the flattened region.

Other aspects of the present invention will become apparent upon consideration of the following detailed description, wherein similar structures have similar reference numerals.

DETAILED DESCRIPTION

A reclosable pouch according to some aspects of the present disclosure has a slider-actuated closer mechanism that includes features that help retain the slider on the closure mechanism. While specific embodiments are discussed herein, it is understood that the present disclosure is to be considered only as an exemplification of the principles of the invention. For example, where the disclosure herein is illustrated with particular reference to two hooked interlocking members disposed on each of two opposing elongate closure elements, it will be understood that any number of hooked interlocking members, including one or more, and/or other shaped interlocking members can be used if desired. Similarly, where the disclosure is illustrated herein with one guide rail disposed on each of two closure elements, it will be understood that fewer or more guide rails may be disposed on one or both of the closure elements. In addition, various other slider designs may also be adapted for use in a manner consistent with the scope of the present disclosure.

Figure 1A:
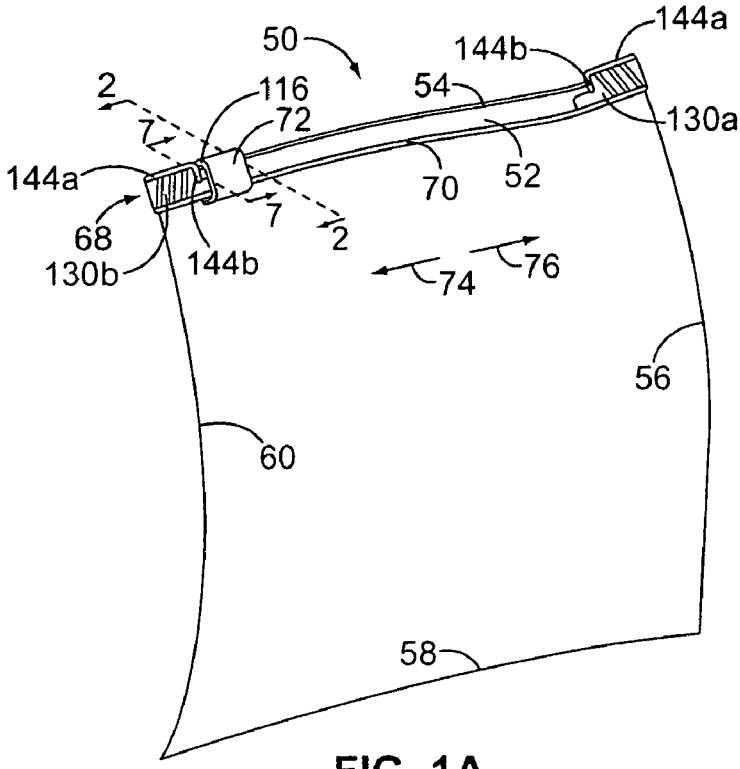
FIG. 1A is an isometric view of a reclosable pouch with an embodiment of a slider-actuated closure mechanism in a closed state.
Figure 1B:
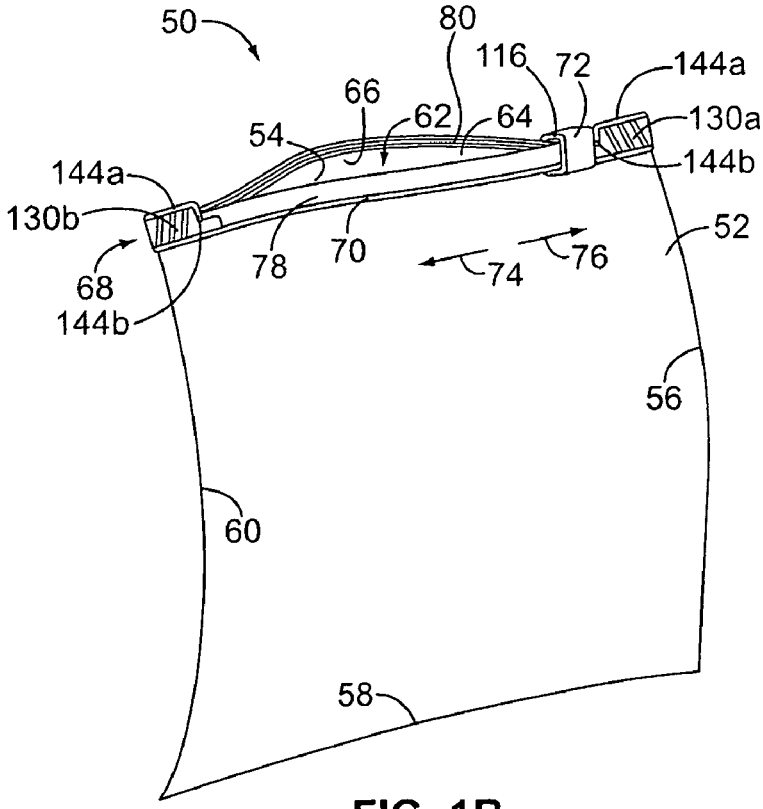
FIG. 1B is an isometric view of the reclosable pouch of FIG. 1A with the slider-actuated closure mechanism in an open state.

FIGS. 1A and 1B illustrate a reclosable pouch 50 having a first pouch sidewall 52 and a second pouch sidewall 54 that are connected by, for example, folding, heat sealing, and/or an adhesive, along three peripheral edges 56, 58, 60 to define a pouch interior 62 between the first and second pouch sidewalls 52, 54 and an opening 64 along a top edge 66 where the first and second pouch sidewalls 52, 54 are not attached so as to allow access into the pouch interior 62. A slider-actuated closure mechanism 68 is disposed along the first and second pouch sidewalls 52, 54 near the opening 64 and extends between the peripheral edge 56 and the peripheral edge 60 of the pouch 50 to allow the opening 64 to be repeatedly occluded and deoccluded. A guide rail 70 as further discussed hereinbelow is disposed on an outer surface of each opposite side of the closure mechanism 68. Preferably, the guide rail 70 extends the entire length between the peripheral edge 58 and the peripheral edge 60 on each side of the closure mechanism 68. A slider 72 is straddlingly disposed over the guide rails 70 of the slider-actuated closure mechanism 68 such that sliding movement of the slider 72 in a first direction along the length of the closure mechanism, as indicated by the arrow 74, occludes the closure mechanism, and sliding movement of the slider 72 in an opposite, second direction along the length of the closure mechanism, as indicated by the arrow 76, deoccludes the closure mechanism. Illustrative closure elements useful in the present invention include those disclosed in, for example, U.S. Patent Application No. 61/047,247, filed Apr. 23, 2008, which is incorporated by reference herein in its entirety. Other closure mechanisms with other elongate profiles may also or alternatively be used.

Figure 2:
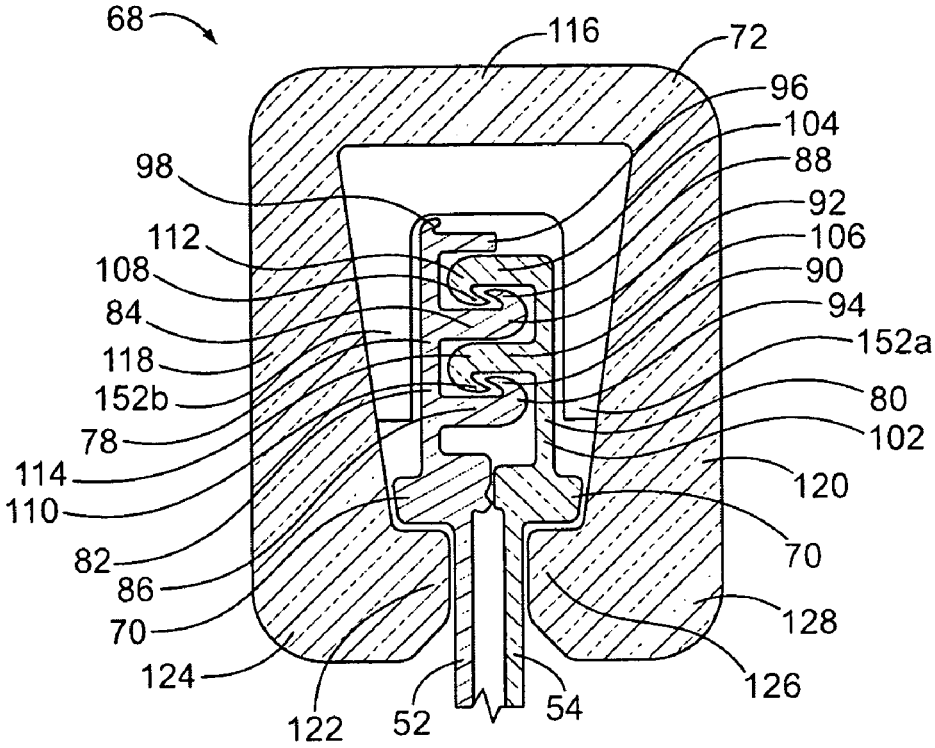
FIG. 2 is a cross-sectional view along the lines 2-2 of FIG. 1A.
Figure 6:
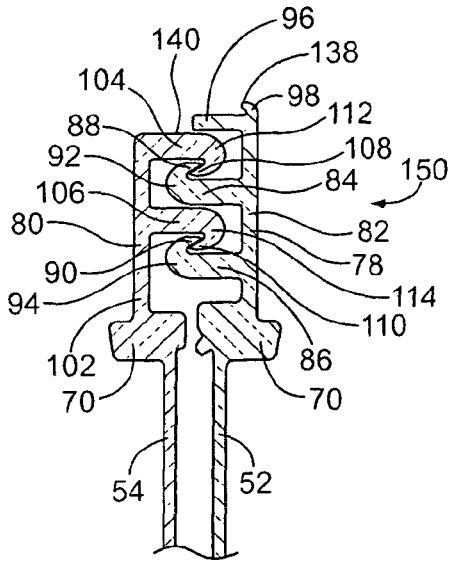
FIG. 6 is a cross-sectional view along the lines 6-6 of FIG. 3.

Referring now to FIGS. 1B, 2, and 6, in one embodiment the slider-actuated closure mechanism 68 includes a first closure element 78 that releasably interlocks with an opposing second closure element 80. Illustratively, each of the first and second closure elements 78, 80 has a substantially constant elongate cross-sectional profile that extends longitudinally between opposite longitudinal ends of the closure mechanism 68 to form a continuous seal therealong when fully interlocked with the opposing closure element. The first closure element 78 may be disposed on an interior surface or an exterior surface of the first pouch sidewall 52 or may be integral therewith. Similarly, the second closure element 80 may be disposed on an interior surface or an exterior surface of the second pouch sidewall 54 or may be integral therewith.

As best seen in profile in FIGS. 2 and 6, the first closure element 78 includes a first base 82 and first and second interlocking members 84, 86 extending therefrom. Each of the first and second interlocking members 84, 86 includes a hooked portion 88, 90 disposed at a respective distal end 92, 94 thereof. The first base 82 may include a horizontal member 96 extending therefrom above the first interlocking member 84. The horizontal member 96 may be configured, for example, to provide additional rigidity to the first base 82, or to provide an engagement surface for a separation finger of the slider 72 to facilitate deocclusion of the closure mechanism 68. The first base 82 may also include an upward extension 98 disposed above the horizontal member 96. The upward extension 98 may be configured, for example, long enough to limit the vertical range of motion of the slider 72 when mounted on the first and second closure elements 78, 80. The second closure element 80 includes a second base 102 and third and fourth interlocking members 104, 106 extending therefrom. Each of the third and fourth interlocking members 104, 106 includes a hooked portion 108, 110 disposed at a respective distal end 112, 114 thereof. The hooked portions 88, 90 of the first and second interlocking members 84, 86 releasably interlockingly engage with the hooked portions 108, 110 of the third and fourth interlocking members 104, 106, respectively, when the first and second closure elements 78, 80 are in an occluded state.

Referring again to FIG. 2, the slider 72 includes first and second slider sidewalls 118, 120 that are spaced apart and depend vertically downwardly from opposite side edges of a slider top wall 116. The first slider sidewall 118 has a first in-turned shoulder 122 disposed at a bottom distal end 124 thereof, and the second slider sidewall 120 has a second in-turned shoulder 126 disposed at a bottom distal end 128 thereof. Each of the guide rails 70 extends from an exterior side of a respective one of the first and second bases 82, 102. The first and second shoulders 122, 126 of the slider 72 project inwardly toward each other beneath the guide rails 70 in order to prevent the slider from being removed transversely upwardly from the closure mechanism 68.

Figure 3:
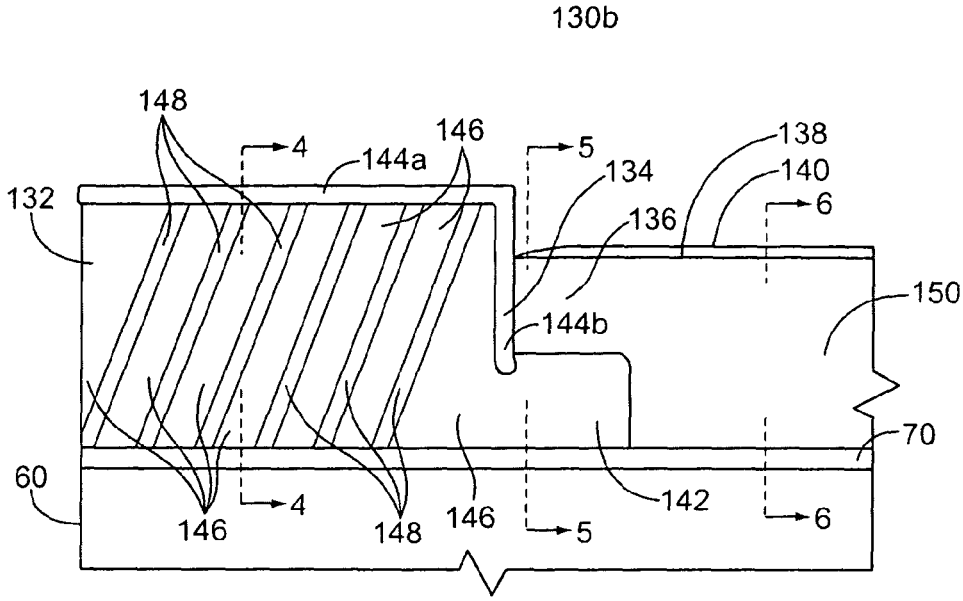
FIG. 3 is an enlarged side view of an end-stomp on the slider-actuated closure mechanism of FIG. 1A.

As illustrated in FIGS. 1A, 1B, and 3, end-stomps 130*a* and 130*b* may be formed by permanently fusing together opposite longitudinal end regions of the first and second complementary closure elements 78, 80 proximate the peripheral edges 56 and 60, respectively, for example, by application of ultrasonic energy and pressure and/or application of heat and pressure and/or other fusing techniques known in the art. As best seen in FIG. 3, the end-stomp 130*b* includes a fused together region 132 that extends between the peripheral edge 60 and a region 134 that abuts an un-fused region 136 of the first and second complementary closure elements 78, 80. The fused together region 132 extends upwardly beyond exterior or upper lateral edges 138, 140 of the first and second closure elements 78, 80, respectively. A portion 142 of the fused together region 132 also extends longitudinally beyond and below the un-fused region 136 on a side of the un-fused region 136 that is opposite the upper lateral edges 138, 140. Similarly, the end-stomp 130a, illustrated in FIGS. 1A and 1B, may have a structure identical to the end-stomp 130*b*, but oriented as a mirror image thereto, or another end-stomp with another structure may also or alternatively be used.

Figure 4:
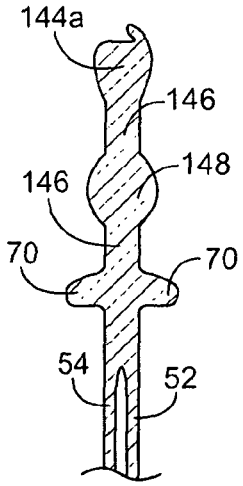
FIG. 4 is a cross-sectional view along the lines 4-4 of FIG. 3.

Referring to FIGS. 3 and 4, each end-stomp 130*a*, 130*b* is molded into a generally thin fused-together flattened region, which is strengthened by regions of increased material thickness as measured laterally therethrough, such as ridges, or ribs, formed in the exterior surface thereof The ribs on each side of the end-stomps may be formed by corresponding grooves in an otherwise flat face of each of a respective ultrasonic hammer and anvil stomp press. The regions of increased material thickness include a horizontally oriented top rib 144*a* that runs along a top edge of the end stomp 130*b* substantially parallel to the first and second interlocking members 84, 86, a vertically oriented edge rib 144*b* extending downwardly from an end of the top rib 144a immediately adjacent the un-fused region, and an optional plurality of internal parallel ribs 148, for example, diagonally oriented and extending from the rail 70 to the top rib 144*a*. The optional plurality of parallel ribs 148 may provide a gripping surface for a consumer or may be replaced or supplemented with optional indicia such as a letter, word, or other image. Each of the top rib 144*a*, edge rib 144*b*, and optional ribs 148 has a greater thickness than central portions 146 of the end-stomp 130*b*, which generally define a thin fused together flattened region. The thickness of the top rib 144*a* may be greater than, equal to, or less than the thickness of the edge rib 144*b*. As seen in FIG. 4, each of the ribs 144*a*, 144*b*, and 148 is preferably formed on each opposite side of the end stomp 130*b*, although it is foreseeable that the ribs may be formed on only one side of the end stomp or some ribs on one side and other ribs on the other side.

In operation, the slider 72 is inhibited from moving transversely vertically due to contact with the upward extension 98 and the guide rails 70; however, the slider 72 may travel longitudinally horizontally along the length of the guide rails 70 between the end-stomps 130a and 130*b* formed at the end regions of the first and second closure elements 78, 80. As illustrated in FIG. 1B, proximate the first peripheral edge 56, the slider 70 is limited from further travel toward the first peripheral edge 56 because the end-stomp 130*a* extends upwardly away from the guide rails 70 a distance sufficient to engage at least some portion of the top wall 11 6 of the slider 72, and preferably though not necessarily equal to or greater than a vertical thickness of the top wall 116 of the slider 72. Thus the top wall 116 of the slider 72 is blocked by the edge rib 144*b* of the end-stomp 130*a* from further horizontal travel toward the first peripheral edge 56. Similarly, as illustrated in FIG. 1A, proximate the second peripheral edge 60, the top wall 116 of the slider 72 is blocked by the end-stomp 130*b* from further horizontal travel toward the second peripheral edge 60. Preferably, the top wall 116 of the slider 72 abuts squarely against the edge rib 144*b*, thereby minimizing or eliminating any upward ramping forces that might otherwise occur when the slider 72 engages the end-stomp 130*b* if the edge rib 144*b* were not vertically oriented. In addition, engagement of the top wall 116 against the edge rib 144*b* limits or possibly eliminates any bending stresses on a separation finger, such as 154 discussed below, that might further cause upwardly directly ramping forces on the slider 72 until the entire end-stomp 130*b* begins to buckle. Furthermore, the top rib 144*a* further strengthens the end-stomp 130*b* by resisting backward collapse of the edge rib 144*b* when impacted by the top wall 116 of the slider 72, which also thereby may improve an ultimate pull-off failure strength of the slider 72 from the closure mechanism 68 when the slider 72 engages against the end-stomp 130*b*. When the slider 72 abuts against the edge rib 144*b*, the in-turned shoulders 122 and 126 are still engaged underneath the respective rails 70 under the fused together region 132 to further help prevent the slider from vertically disengaging from the closure elements 78, 80. Thus, the end-stomps 130*a* and 130*b* inhibit the slider 72 from inadvertently being pulled off of each end of the closure mechanism 68 and can make up for a loss in strength caused by using a lesser quantity of material and/or a less resilient material for the slider 72 by including the selectively arranged ribs 144*a* and 144*b* for strengthening the end-stomps 130*a* and 130*b*.

Figure 5:
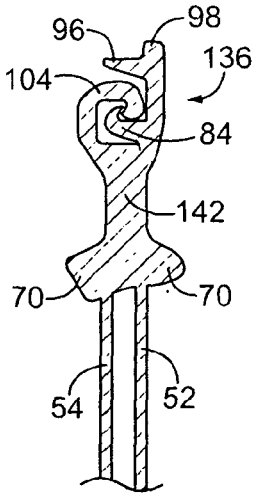
FIG. 5 is a cross-sectional view along the lines 5-5 of FIG. 3.

Referring to FIGS. 4-6, the end-stomp 130*b* may be described in more detail across three characteristic cross-sectional profile regions thereof. FIG. 4 illustrates a region of the end-stomp 130*b* that has been entirely fused together from the guide rails 70 to the top rib 144*a*. FIG. 5 illustrates a region of the end-stomp 130*b* that has been fused together in the region 142 that extends between the un-fused region 136 and the guide rails 70. FIG. 6 illustrates a region 150 outside of the region of the end-stomp 130*b* where the closure elements 78 and 80 are not fused together anywhere.

Figure 7:
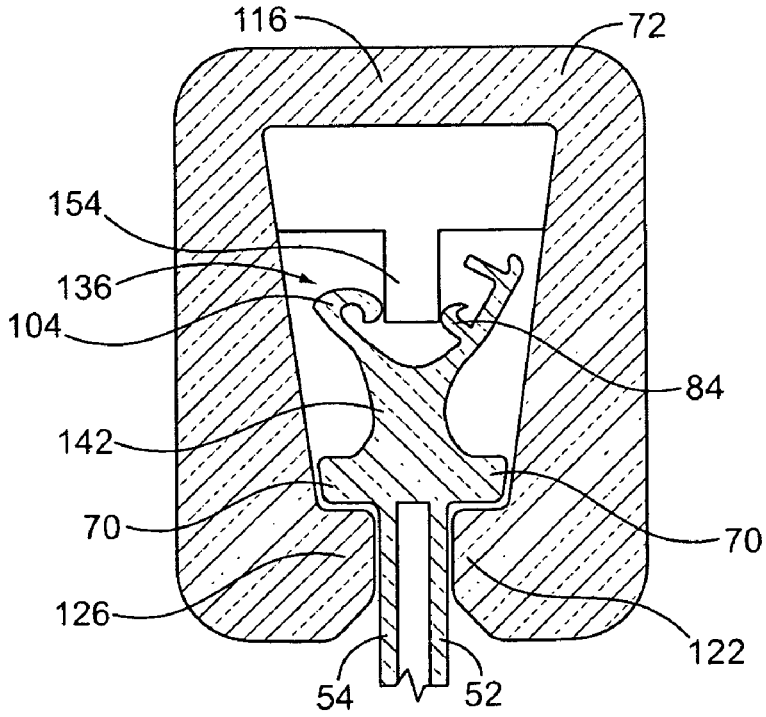
FIG. 7 is a cross-sectional view along the lines 7-7 of FIG. 1A.

As best seen in FIG. 2, the slider 72 includes internal occlusion walls 152*a*, 152*b* that push or squeeze the first and second closure elements 78, 80 together to force occlusion thereof. The bottom ends of the occlusion walls 152*a*, 152*b* are spaced above the shoulders 122, 126, which provides sufficient clearance to accommodate the vertical extent of the outward projection of the guide rails 70. Referring now to FIG. 7, the slider 72 also includes a separation finger 154 that extends downwardly from a medial location of the top wall 116 a sufficient length to separate one or more pairs of corresponding interlocked closure profiles, such as the first and second interlocking members 84, 86 from respective interlocking engagement with the third and fourth interlocking members 104, 106. Preferably, the separation finger 154 extends only between the first and third interlocking members 84, 104 and does not extend between the second and fourth interlocking members 104, 106. In any event, it is preferred that the portion 142 of the end stomp 130*b* is disposed immediately below the lower distal end of the separation finger 154 such that, when the slider 72 is positioned as shown in FIG. 1A with the closure mechanism 68 is in a closed state, the un-fused region 136 of the end-stomp 130*b* accommodates the separation finger 154. Such accommodation helps to keep the separation finger 154 centered between the first and second closure elements 78, 80, which facilitates contact between the separation finger 154 and the edge rib 144*b*. Such contact inhibits the separation finger 154 from damaging the first and second closure elements 78, 80 in the un-fused region 136 when the closure mechanism 68 is in the closed state.

Preferably, in one embodiment the slider is formed of polypropylene and the closure mechanism, including the closure elements 78, 80 and the end-stomps 130*a*, 130*b*, are formed of polyethylene or a polyethylene blend by thermal extrusion of the closure elements and subsequent heat and/or compression fusion of the end stomps.

Various details shown in FIGS. 1-7 may be modified as will be apparent to those of skill in the art without departing from the disclosed principles. Other methods and materials suitable for forming structures of the present invention may also be utilized.

INDUSTRIAL APPLICABILITY

A slider-actuated closure mechanism that may be used on a reclosable pouch has been presented. A raised and strengthened end-stomp is disposed at one or both ends of the closure mechanism that, in some instances, may provide improved or at least comparable slider pull-off strength relative to prior closure mechanisms despite forming the slider and/or the closure mechanism of less material and/or less expensive materials. A slider is retained on the slider actuated closure mechanism in straddling relation to guide bars thereon such that the slider slides easily without requiring excessive application of force. Each end-stomp provides a barrier to inhibit the slider from being pulled transversely and/or longitudinally off of the closure mechanism.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive right to all modifications within the scope of the impending claims is expressly reserved. All patents, patent publications and applications, and other references cited herein are incorporated by reference herein in their entirety.

I claim:

1. A reclosable pouch, comprising:

first and second pouch sidewalls attached together to define a pouch interior having an opening defined by unattached edges of the first and second pouch sidewalls;

a closure mechanism extending between a first side edge and a second side edge of the pouch, wherein the closure mechanism includes first and second complementary interlocking closure elements attached proximate to the unattached edges of the first and second pouch sidewalls, respectively, each closure element having an elongate profile extending between a first end and a second end;

first and second guide rails disposed on exterior sides of the first and second complementary interlocking closure elements, respectively, wherein each of the guide rails extends completely from the first side edge to the second side edge;

a slider disposed in straddling relation over the guide rails of the first and second complementary interlocking closure elements; and an end-stomp defined by a fused-together portion of the first and second interlocking closure elements proximate one of the ends of the closure mechanism, the end-stomp including a flattened region that is substantially symmetrical about a vertical transverse centerline of the closure mechanism, a first raised ridge that is substantially parallel to the interlocking closure elements, and a second raised ridge that is substantially perpendicular to the first raised ridge, wherein the second raised ridge abuts an un-fused region of the closure mechanism and extends away from the pouch interior and beyond opening side lateral edges of the first and second complementary interlocking closure elements a distance that is at least as large as a vertical thickness of a slider top wall, and wherein each of the first raised ridge and the second raised ridge has a first lateral thickness greater than a second lateral thickness of the flattened region.

2. The reclosable pouch of claim 1, wherein the end-stomp extends between the pouch interior and the un-fused region of the closure mechanism.

3. The reclosable pouch of claim 2, wherein the closure mechanism includes an upper set of complementary interlocking members on an opening side thereof and a lower set of complementary interlocking members on a pouch interior side thereof, wherein the upper set of interlocking members extend into the un-fused region and the end-stomp includes a fused-together portion of the lower set of complementary interlocking members disposed on a pouch interior side of the un-fused region.

4. The reclosable pouch of claim 3, wherein the un-fused region of the closure mechanism accommodates a separation finger of the slider when the slider abuts the end-stomp.

5. The reclosable pouch of claim 1, wherein the slider is made of polypropylene.

6. The reclosable pouch of claim 5, wherein the first and second complementary interlocking closure elements are made of polyethylene or a polyethylene blend.

7. A closure mechanism for a reclosable pouch, comprising:

first and second complementary elongate interlocking closure elements;

a slider disposed in straddling relationship to the first and second closure elements and adapted to slide along a length of and occlude and deocclude the closure elements;

an end-stomp disposed proximate an end of the closure mechanism, the end-stomp defined by a fused-together region of the first and second complementary interlocking closure elements that includes a flattened region that is substantially symmetrical about a vertical transverse centerline of the closure mechanism, a first raised ridge that is substantially parallel to the interlocking closure elements, and a second raised ridge that is substantially perpendicular to the first raised ridge, wherein the second raised ridge abuts an un-fused region of the closure mechanism and extends away from the pouch interior and beyond opening side lateral edges of the first and second complementary interlocking closure elements, and wherein each of the first raised ridge and the second raised ridge has a first lateral thickness greater than a second lateral thickness of the flattened region; and first and second guide rails disposed along the first and second complementary interlocking closure elements, respectively.

8. The closure mechanism of claim 7, wherein the end-stomp extends beyond the portion that abuts the un-fused region on a side of the un-fused region opposite the opening side lateral edges.

9. The closure mechanism of claim 8, wherein the first and second complementary interlocking closure elements include a lower set of complementary interlocking closure profiles and an upper set of complementary interlocking closure profiles disposed between the lower set of complementary interlocking closure profiles and the opening side lateral edges, wherein the end-stomp includes the lower set of complementary interlocking closure profiles.

10. The closure mechanism of claim 7, wherein each of the guide rails extends completely from the first side edge to the second side edge.

11. The closure mechanism of claim 10, wherein the slider is disposed in straddling relationship to the first and second guide rails disposed along the first and second complementary interlocking closure elements.

12. The closure mechanism of claim 11, wherein the second raised ridge extends beyond the opening side lateral edges of the first and second complementary interlocking closure elements a distance that is sufficient to engage a slider top wall.

13. The closure mechanism of claim 12, wherein the unfused region of the closure mechanism accommodates a separation finger of the slider when the slider abuts the end-stomp.

14. The closure mechanism of claim 7, wherein the slider is made of polypropylene and the first and second complementary interlocking closure elements are made of polyethylene or a polyethylene blend.

* * * * *